US009739468B2

(12) United States Patent
Zheng

(10) Patent No.: US 9,739,468 B2
(45) Date of Patent: Aug. 22, 2017

(54) EMBEDDED LED LAMP

(71) Applicant: Fuan Oumeida Electric Machine Co., Ltd., Fuan, Fujian (CN)

(72) Inventor: Yaofu Zheng, Fujian (CN)

(73) Assignee: FUAN OUMEIDA ELECTRIC MACHINE CO., LTD, Fuan (CN)

( * ) Notice: Subject to any disclaimer, the term of this patent is extended or adjusted under 35 U.S.C. 154(b) by 92 days.

(21) Appl. No.: 14/952,534

(22) Filed: Nov. 25, 2015

(65) Prior Publication Data

US 2017/0038049 A1 Feb. 9, 2017

(30) Foreign Application Priority Data

Aug. 7, 2015 (CN) ..... 2015 2 0593402 U

(51) Int. Cl.

| | |
|---|---|
| ***F21V 29/10*** | (2015.01) |
| ***F21V 21/04*** | (2006.01) |
| ***F21V 23/02*** | (2006.01) |
| ***F21V 7/04*** | (2006.01) |
| *F21Y 101/02* | (2006.01) |

(52) U.S. Cl.

CPC ..... *F21V 29/10* (2015.01); *F21V 7/04* (2013.01); *F21V 21/047* (2013.01); *F21V 23/02* (2013.01); *F21Y 2101/02* (2013.01)

(58) Field of Classification Search

CPC ..... F21V 29/10; F21V 7/04; F21V 21/047; F21V 23/02; F21V 21/04; F21V 1/00; F21V 5/00; F21V 7/00; F21V 13/02; F21V 13/04; F21V 13/00; F21Y 2101/02

See application file for complete search history.

(56) References Cited

U.S. PATENT DOCUMENTS 9,028,086 B2 * 5/2015 Woo ..... F21V 7/04 362/294

9,476,581 B2 * 10/2016 Wu ..... F21V 31/005

* cited by examiner

*Primary Examiner* — Bao Q Truong

(74) *Attorney, Agent, or Firm* — Mei & Mark LLP

(57) ABSTRACT

The present disclosure relates to the field of lamps and lighting, in particular to an embedded LED lamp. In one example, an embedded LED lamp includes a power supply device, a lampshade; an LED light module, a reflector, and a lens. The power supply device includes a cup-shaped housing and a power supply unit provided within the housing. An opening end of the housing is detachably connected to an outer side of a bottom surface of the lampshade. The reflector is positioned within the lampshade. The reflector is detachably connected to an inner side of the bottom surface of the lampshade. A large opening at a front end of the reflector is detachably connected to the lens. The LED light module is attached at the inner side of the bottom of the lampshade in an area surrounded by an opening at a rear end of the reflector. The practice of the present disclosure may reduce the effects of heat on a power supply device, and an embedded LED lamp may have less light loss, good heat dissipation, and provide softer light. The disclosed embedded LED lamp is simple, with low manufacturing cost and convenient assembly.

14 Claims, 4 Drawing Sheets

EMBEDDED LED LAMP

CROSS-REFERENCE TO RELATED APPLICATION

This application claims priority to and incorporates herein Chinese Application No. 201520593402.7 filed on Aug. 7, 2015.

TECHNICAL FIELD

The present disclosure relates to the field of lamps and lighting, in particular to an embedded LED lamp.

BACKGROUND

LEDs have the advantages of saving energy, being environmentally friendly, having a long life, and having a small size. As such, they have been referred to as the fourth generation light source or green light. They are widely used in various fields relating to guideboards, displaying, decoration, backlights, general lighting, and urban landscaping.

Currently, LEDs are combined with reflectors according to needs of a particular application. The combination of a reflector and a lens makes light from a LED lamp richer, softer, and more uniformly emitted, so as to protect eyes. Moreover, it is desirable to uniformly scatter light emitted from LEDs through a lens while avoiding energy dissipation within the reflector, such that (1) users cannot see light beads and (2) that a maximum amount of light can be provided. In addition, LED lamps are in great demand and need to be adapted to a variety of applications. It is therefore particularly important to be able to conveniently assemble LED lamps.

Notwithstanding the above, LED lamps made with existing technology are complicated, with high manufacturing cost and inconvenient assembling. Accordingly, it is desirable to provide a new LED lamp.

SUMMARY

In view of the above, an object of the present disclosure is to provide an embedded LED lamp to address the problems of complicated structure, high manufacturing cost, and inconvenient assembly of LED lamps made with existing technology.

In one example, an embedded LED lamp includes a power supply device, a lampshade, an LED light module, a reflector, and a lens. The power supply device includes a cup-shaped housing and a power supply unit provided within the housing. An opening end of the housing is detachably connected to an outer side of a bottom surface of the lampshade. The reflector is positioned within the lampshade. The reflector is detachably connected to an inner side of the bottom surface of the lampshade. A large opening at a front end of the reflector is detachably connected to the lens. The LED light module is attached at the inner side of the bottom of the lampshade in an area surrounded by an opening at a rear end of the reflector.

In another example, the embedded LED lamp further includes a lamp ring, which is matched and assembled with an opening of the lampshade.

In yet another example, the embedded LED lamp further includes a spring securing element and a metal torsion spring. The spring securing element has a fixing portion, a connecting portion, and a snap-fit portion. The fixing portion, the connecting portion, and the snap-fit portion are integrally formed. The fixing portion is detachably connected to the outer side of the bottom surface of the lampshade. The connection portion extends from the fixing portion and is connected to or fitted with a side wall of the lampshade. The snap-fit portion extends from the connection portion and includes snap-fit collar. The metal torsion spring is provided in the snap-fit collar.

In yet another example, the fixing portion is provided with a hook portion. A curvature of the connecting portion is substantially the same as that of an outer side of the side wall the lampshade. The snap-fit portion comprises a first snap-fit portion and a second snap-fit portion extending from the first snap-fit portion. A cross-section of the snap-fit portion is S-shaped; and a cross-sectional radius of the first snap-fit portion is not equal to that of the second snap-fit portion.

In yet another example, the metal torsion spring is formed by two small coils and a large coil. Each of the two small coils and the large coil are coiled separately. The large coil is located between the two small coils. A first torsion arm and a second straight torsion arm extend from the two small coils, respectively, toward a same side.

In yet another example, the lampshade is made of a conductive material and the side wall of the lampshade is threaded.

In yet another example, the outer side of the bottom surface of the lampshade is provided with a positioning groove. The housing and the spring securing element are respectively engaged with opposite sides of the positioning groove.

In yet another example, an outer side of the side wall of the reflector is provided with a plurality of evenly spaced cylinders. A plurality of projections are provided on bottom surface of the lampshade at positions that correspond to those of the cylinders. The cylinders and projections have threaded holes and are configured to be respectively attached with screws.

In yet another example, the power supply device further comprises a push-in terminal and the push-in terminal is connected to the power supply unit.

In yet another example, the cross-section of lamp ring is arc-shaped.

Compared with the prior art, an embedded LED lamp of the present disclosure, a power supply unit, and a LED light module are separated from each other, increasing the space for heat dissipation and the paths for heat dissipation. In this way, the effect of heat on the power supply device may be reduced. The embedded LED lamp will have less light loss, good heat dissipation, and provide softer light. Further, the disclosed embedded LED lamp is simple, with low manufacturing costs and convenient assembly.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate the embodiments of the present disclosure and together with the description, serve to explain the principles of the invention.

DETAILED DESCRIPTION

References will now be made in detail to the present exemplary embodiments, examples of which are illustrated in the accompanying drawings. Wherever possible, the same reference numbers will be used throughout the drawings to refer to the same or like parts. While the description includes exemplary embodiments, other embodiments are possible, and changes may be made to the embodiments described without departing from the spirit and scope of the invention. The following detailed description does not limit the invention. Instead, the scope of the invention is defined by the appended claims and their equivalents.

Figure 1:
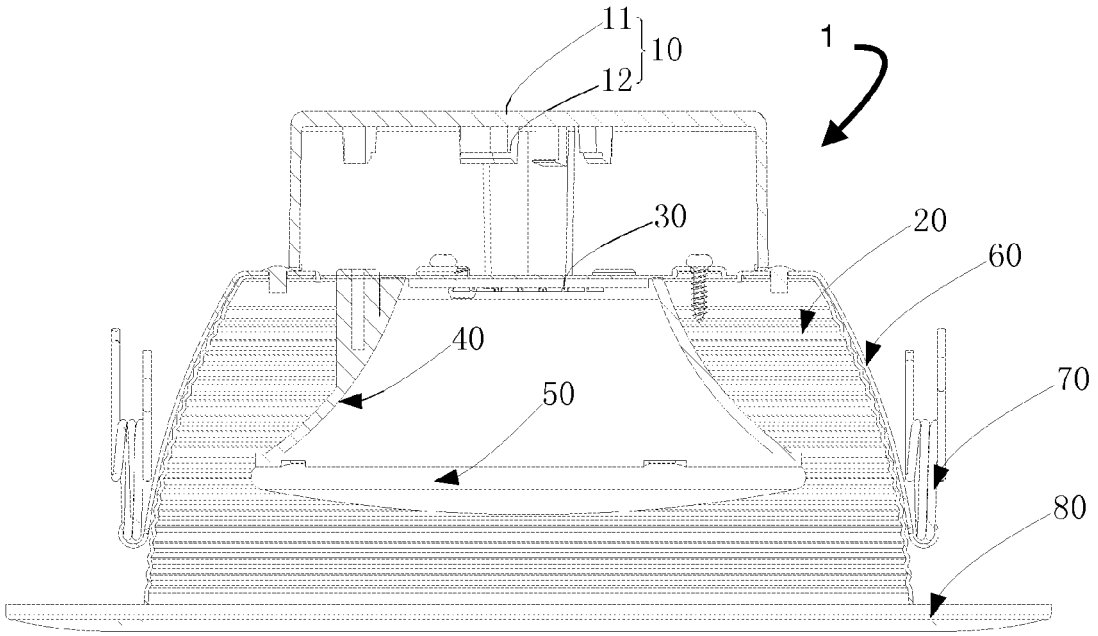
FIG. 1 is a cross-sectional view of an embodiment of the embedded LED lamp of the present disclosure.

FIG. 1 depicts an embedded LED lamp according to the present disclosure. The embedded LED lamp 1 may include a power supply device 10, a lampshade 20, a LED light module 30, a reflector 40, and a lens 50. The power supply device 10 comprises a cup-shaped housing 11 and a power supply unit 12 provided within the housing 11. The opening end of the housing 11 is detachably connected to the outer side of the bottom of the lampshade 20. The reflector 40 is located within the lampshade 20, and the small opening 41 end of the reflector 40 within the lampshade 20 is detachably connected to the inner side of the bottom of the lampshade 20. The large opening 43 end of the reflector 40 is detachably connected to the lens 50. The LED light module 30 is fixed at the inner side of the bottom of the lampshade 20 in an area that is surrounded by the opening end of the housing 11.

In some embodiments, the reflector 40 has a bottom surface at its rear end. In such embodiments the LED light module 30 may be fixed at the inner side of the bottom surface of the rear end of reflector 40.

The opening end of the housing 11 may be affixed to the outer side of the bottom surface of the lampshade 20 via screws, and constitutes an enclosed space along with the bottom surface of the lampshade 20. The power supply unit 12 is provided on the inner wall of a side of the housing 11 that is away from the lampshade 20, ensuring a stable power supply so that the embedded LED lamp can work smoothly. The LED light module 30 is provided on the inside of the bottom surface of the lampshade 20, which is away from the power supply device 10. In this way, the power supply unit 12 and the LED light module 30 are spaced away from one another. Thus, the power supply unit 12 is unlikely to be adversely affected by the heat from the LED light module 30, thereby extending the life of the power supply unit. The reflector 40 is substantially trumpet-shaped with a small opening 41 end and large opening 43 end. The small opening 41 end of reflector 40 surrounds the area where the LED light module 30 is located and is fixed to the inner side of the bottom of the lampshade 20, such that the light emitted from LED light module 30 can only travel out through the large opening 43 end of the reflector 40. The lens 50 is snap-fitted in the large opening 43 end of the reflector 40. In this embodiment, the reflector 40 can make light become soft, and the soft light travels through the lens 50 so that the light can be uniformly dispersed. The whole reflector 40 may be located inside the lampshade 20. Light passes through the lens 50 and may be further uniformly and softly dispersed by the lampshade 20.

In the embedded LED lamp of the present disclosure, the power supply unit 12 and the LED light module are respectively enclosed in separate spaces by housing 11 and lampshade 20. Part of the role of a bulb of a conventional lamp is accomplished by a combination of the trumpet-shaped reflector 40 and the lens 50 provided at the large opening end of the reflector 40. The emitted light is softened and evenly dispersed though this configuration. The LED lamp has a larger space for heat dissipation and less light loss than a conventional lamp. Its structure is simple, with low manufacturing cost and convenient assembly.

Figure 2:
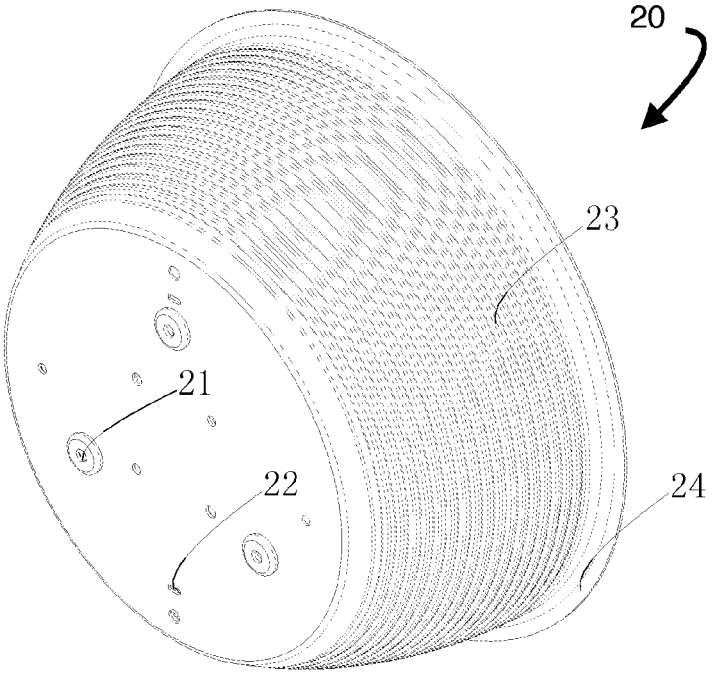
FIG. 2 is a view of a lampshade of an embodiment of the embedded LED lamp of the present disclosure.
Figure 3:
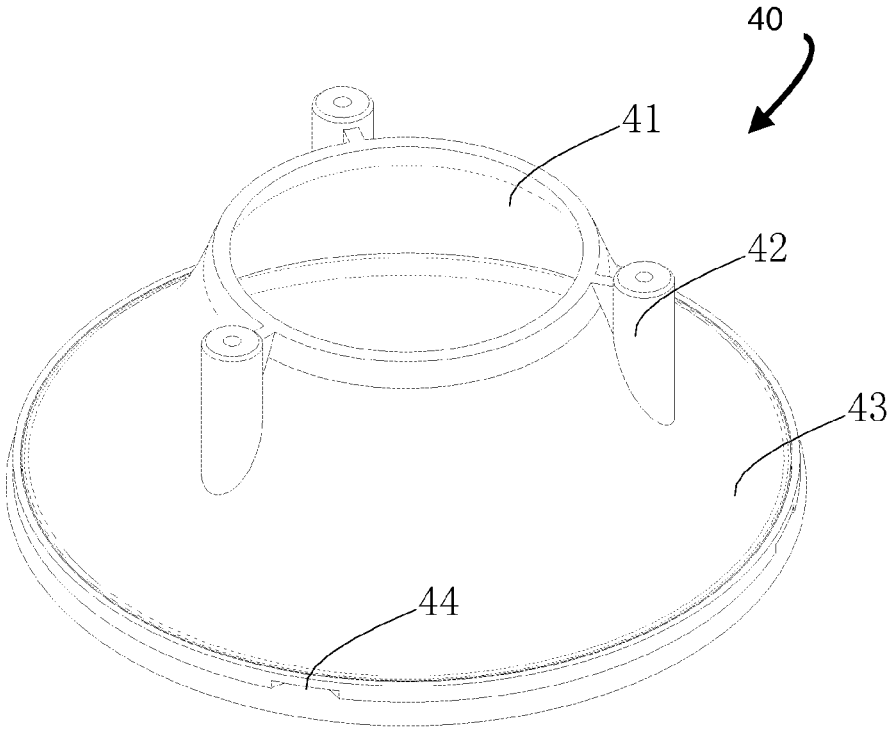
FIG. 3 is a view of a reflector of an embodiment of the embedded LED lamp of the present disclosure.
Figure 4:
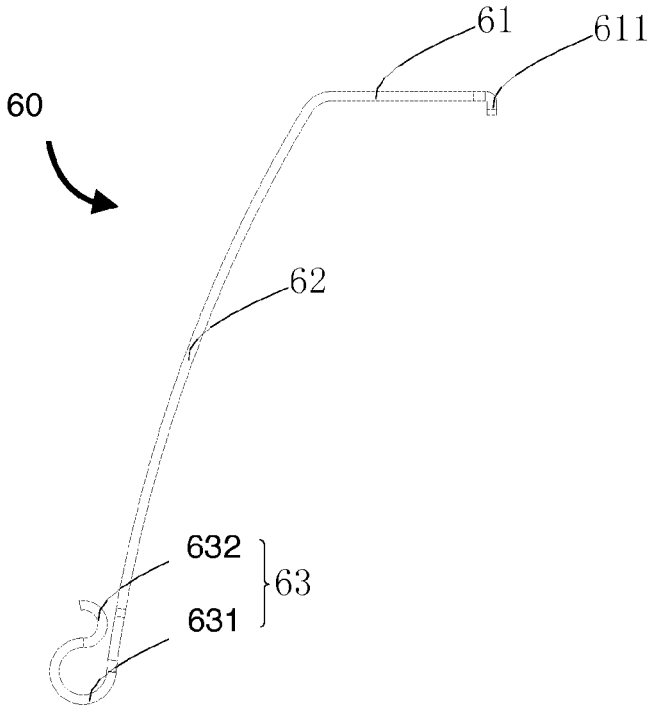
FIG. 4 is a cross-sectional view of a spring securing element of an embodiment of the embedded LED lamp of the present disclosure.
Figure 5:
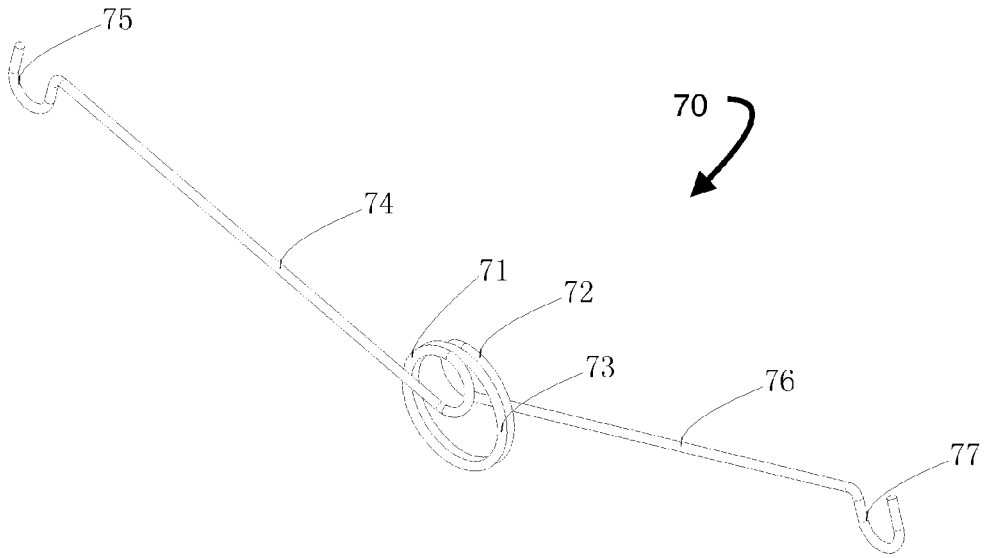
FIG. 5 is a view of a metal torsion spring of an embodiment of the embedded LED lamp of the present disclosure.
Figure 6:
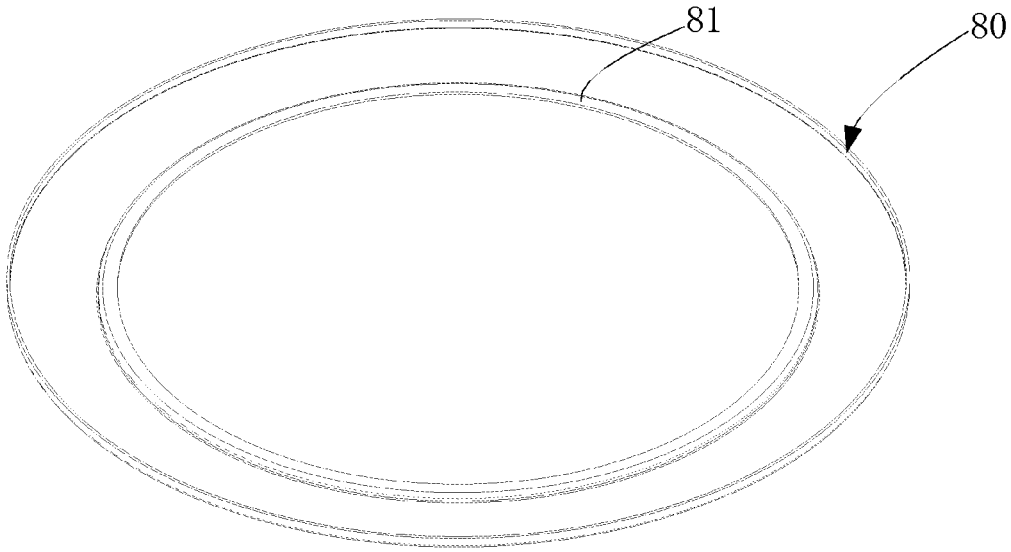
FIG. 6 is a view of a lamp ring of an embodiment of the embedded LED lamp of the present disclosure

FIG. 2 depicts lampshade 20 of an embodiment of the embedded LED lamp according to the present disclosure. FIG. 3 depicts reflector 40 of an embodiment of the embedded LED lamp according to the present disclosure. FIG. 4 depicts spring securing element 60 of an embodiment of the embedded LED lamp according to the present disclosure. FIG. 5 depicts metal torsion spring 70 of an embodiment of the embedded LED lamp according to the present disclosure. FIG. 6 depicts lamp ring 80 of an embodiment of the embedded LED lamp according to the present disclosure.

In a preferred embodiment, as shown in FIG. 2, the lampshade 20 is substantially bowl-shaped. The bottom surface of the lampshade 20 is substantially flat, and is provided with three projections 21 and two positioning grooves 22. The three projections 21 are located on the outside of the bowl shape and are co-circular to each other such that the arc between any two projections 21 measures 120°. The positioning grooves 22 may be provided near the periphery of the bottom of the lampshade 20, external to the projections 21 with respect to the center of the bottom of the lamp shade 20. One of the positioning grooves 22 may be next to one of the projections 21. The positioning grooves may be positioned such that the features of the bottom surface of the lampshade 20 may be symmetrical, with respect to projections 21 and positioning grooves 22. The diameter of the side wall 23 of lampshade 20 gradually expands from the bottom surface of lampshade 20 toward the opening, and the side wall 20 has a thread structure. A matching portion 24 is provided on the side wall 23 at the opening of the lampshade 20. The matching portion 24 extends outside the side wall opening substantially parallel to the bottom surface of the lampshade 20.

As shown in FIG. 3, and discussed above, the reflector 40 is trumpet-shaped with a small opening 41 and a large opening 43. The outside of the wall of the reflector 40 is provided with three cylinders 42, which are configured to correspond to the three projections 21 when the reflector 40 is assembled within lampshade 20. In the present embodiment, the projections 21 and the cylinders 42 all have threaded holes, and may be joined together by screws. The small opening 41 of the reflector 40 has a flat circular edge, which is at the same level as the ends of the cylinders 42. The outside of the reflector 40 is evenly provided with a plurality of slots 44 near the large opening 43.

As shown in FIG. 4, the spring securing element 60, which may be a metal elastic piece, has a fixing portion 61, a connecting portion 62, and a snap-fit portion 63, which are preferably integrally formed. The end of the fixing portion 61 that is distal from the connecting portion 62 is provided with a hook portion 611, which extends and forms an angle of 90° with the body of the fixing portion 61. The connecting portion 62 extends at an angle from the non-hook end of the fixing portion 61. The connecting portion 62 has the shape of a convex arc. The curvature of the connecting portion 62 is substantially the same with that of the outer side of the side wall 23 the lampshade 20. The snap-fit portion 63 extends from the connecting portion 62 away from the end of the fixing portion 61 and is preferably snap-fit collar that may be cylindrical.

The snap-fit portion 63 comprises a first snap-fit portion 631 and a second snap-fit portion 632, which extends from the first snap-fit portion 631. The cross-section of the snap-fit portion 63 is S-shaped, and the cross-sectional radius of the first snap-fit portion 631 is larger than that of the second snap-fit portion 632. A small gap is formed between the second snap-fit portion 632 and the connecting portion 62 for the metal torsion spring 70 to pass through. The end of the second snap-fit portion 632 extends outwardly. In other embodiments, the cross-sectional radius of the first snap-fit portion 631 may be less than or equal to that of the second snap-fit portion 632.

As shown in FIG. 5, the metal torsion spring 70 is formed by a first small coil 71, a large coil 73, and a second small coil 72, which are separately coiled in sequence. Among the coils, the large coil 73 may include a plurality of turns that are close to each other. A first straight torsion arm 74 extends from the first small coil 71, a first fixing hook portion 75 is provided at the end of the first straight torsion arm 74. A second straight torsion arm 76 extends from the second small circle 72, a second fixing hook portion 77 is provided at the end of the second straight torsion arm 76. The first straight torsion arm 74 and the second straight torsion arm 76 expand and extend toward a same side at an angle from each other.

As shown in FIG. 6, the lamp ring 80 is circular, and the inner edge of a first side of the lamp ring 80 is provided with an annular groove 81.

The connection relationships among different components in the embedded LED lamp of the present utility model are further explained with references to FIGS. 1-6.

The screw holes for the three cylinders 42 provided at the back of the reflector 40 are disposed corresponding to the screw holes of the three projections 21 of the lampshade 20. The cylinders 42 and the projections 21 may be fixed together through screws, so that the small opening 41 of the reflector 40 may be secured the inner side of the bottom of the lampshade 20. The LED light module 30 is fixed at the inner side of the bottom of the lampshade 20 in the area surrounded by the small opening 41 of the reflector 40.

As discussed, the outside of the bottom surface of lampshade 20 is provided with two positioning grooves 22 in a preferred embodiment. The housing 11 is engaged at an inner side of the positioning grooves 22, which is closer to the center of the lampshade 20. The fixing portion 61 of the spring securing element 60 is engaged at an outer, opposite side of the respective positioning grooves 22, which is closer to the outer edge of the lampshade 20, with the hook portions 611 extending into the grooves 22. When the hook portions 611 extend into the respective positioning grooves 22, the connecting portion 62 may be connected to or fitted with the outer side wall 23 of the lampshade 20. At this time, the second small coil 73 of the metal torsion spring 70 can be passed through the small gap formed between the second snap-fit portion 632 and the connecting portion 62, so that the metal torsion spring 70 can swing freely.

The outer edge of the lens 50 are provided with protrusions that correspond to with the plurality of slots 44 of reflector 40, such that the lens 50 may be snap-fitted on the larger opening 43 of reflector 40.

Before assembling the spring securing element 60 and the metal torsion spring 70, assembly may require positioning the lamp ring 80 with the side of the lamp ring 80 that has the annular groove 81 facing downward. The lamp ring may sequentially be placed over the housing 11 (with the housing 11 opening facing downward) and the lampshade 20 (with the lampshade 20 opening facing downward), until that the annular groove 81 abuts against the matching portion 24 of the lampshade 20. The depth of the annular groove 81 may be greater or equal to the thickness of the matching portion 24, so that the lamp ring 80 and the lampshade 20 have a smooth connection after the lamp ring 80 is positioned on the matching portion 24.

In alternative embodiments, the matching portion 24 may include an annular groove, and the lamp ring 80 may include a corresponding protrusion, so that a groove of the matching portion 24 and the protrusion of a lamp ring 80 would correspond during assembly.

In the embedded LED lamp of the present disclosure, during assembling, the lampshade 20 can be directly placed at the center through the annular groove 81. In some embodiments, a cross-section of lamp ring 80 may be arc-shaped, enhancing the aesthetic view of the embedded LED lamp. The arc is preferably provided on the second side of the lamp ring 80, opposite from the annual groove 81. The color of the lamp ring 80 can be changed with a variety of choices.

Figure 7:
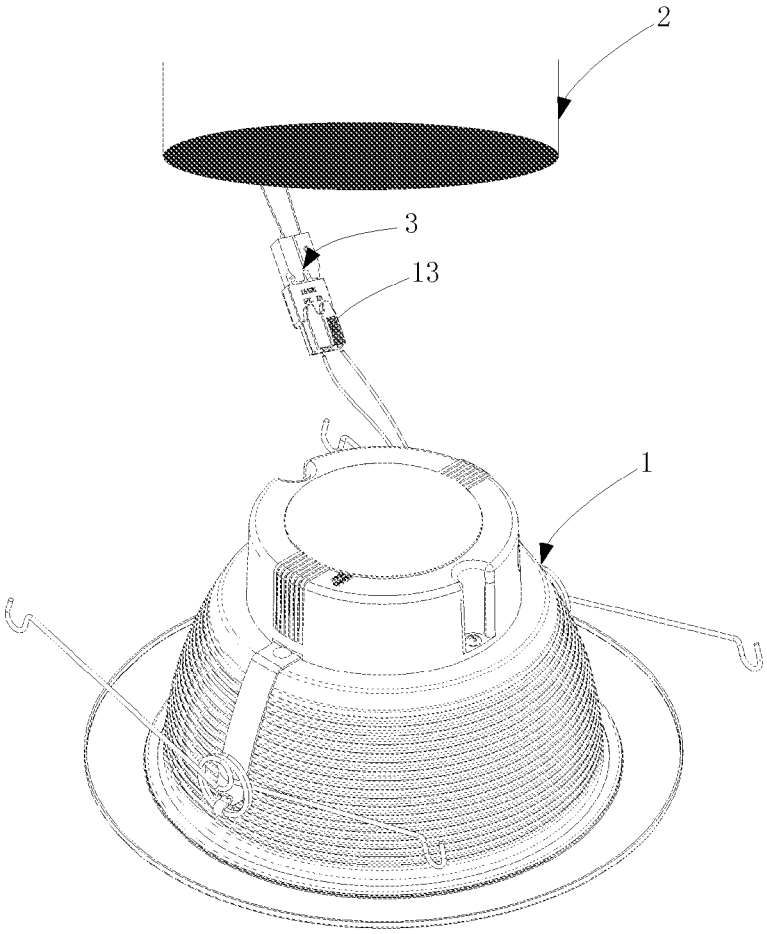
FIG. 7 is a view of an embodiment of the embedded LED lamp of the present disclosure and a light tube before assembling.

In the embedded LED lamp of the present disclosure, the embedded LED lamp can be assembled with different types of light tubes 2 via the presence of at least one pair of a spring securing element 60 and a metal torsion spring 70. As shown in FIGS. 1 and 7, more than one pair of a spring securing element 60 and a metal torsion spring 70 may be used. The fixing portion 61 of the spring securing element 60 is provided with a hook portion 611, the curvature of the connecting portion 62 is substantially the same with that of the outer side of the side wall the lampshade 20, and the cross-section of the snap-fit portion 63 is S-shaped. These characteristics may help make the assembling and disassembling of the spring securing element 60 and the metal torsion spring 70 simple and convenient.

In the embedded LED lamp of the present disclosure, the metal torsion spring 70 is composed of two small coils and a large coil that are coiled separately. The large coil is disposed between the two small coils and two straight torsion arms extend from the two small coils toward a same side at an angle from each other. This permits the first straight torsion arm 74 and the second straight torsion arm 76 to simultaneously exert pressure in opposite directions, facilitating assembling of the embedded LED lamp with different types of light tubes 2.

In the embedded LED lamp of the present disclosure, the side wall 23 of the lampshade 20 is threaded, which endows the lampshade 20 with a more decorative feature, prevents light refraction, gives anti-glare effect, and can increase the heat dissipation area for better cooling effect. In addition, the lampshade 20 may comprise thermally conductive materials such as aluminum, which can further enhance the heat dissipation effect.

In the embedded LED lamp of the present disclosure, the outer side of the bottom of the lampshade 20 is provided with at least one positioning groove. In this way, the housing 11 can conveniently avoid the spring securing element 60 while being secured to the outer side of the bottom surface of the lampshade 20. This facilitates assembly of an embedded LED lamp.

In the embedded LED lamp of the present disclosure, the outer side of the side wall of the reflector 40 is provided with a plurality of evenly spaced cylinder 42, and a plurality of projections 21 are provided at the positions of the lampshade 20 that correspond to those of the cylinders 21, which makes it more convenient to assemble the reflector 40 at the inner side of the bottom of the lampshade 20.

Figure 8:
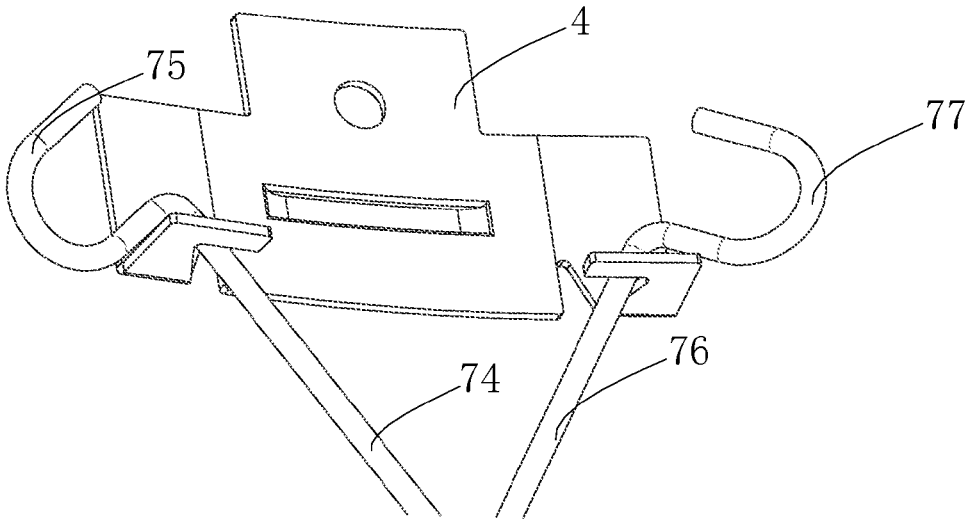
FIG. 8 is a view of the connection of a metal torsion spring and a light tube in accordance with an embodiment of the present disclosure.

The working principles of the embedded LED lamp according to the disclosure may be described with reference to FIGS. 7 and 8. FIG. 7 depicts an embedded LED lamp of the present disclosure and a light tube before installation. FIG. 8 depicts the connection of a metal torsion spring 70 and the light tube after installation of the embedded LED lamp of the present utility model and a light tube.

In this embodiment depicted in FIG. 7, the power supply device 10 further comprises a push-in terminal 13. After assembling an embedded LED lamp, the push-in terminal 13 and the power supply connector 3 of light tube 2 are connected.

Next, the user can manipulate the first straight torsion arm 74 and the second straight torsion arm 76 simultaneously in toward one another, against the force of the spring, so that the first straight torsion arm 74 and the second straight torsion arm 76 are close to each other. Then, then the first straight torsion arm 74 and the second straight torsion arm 76 can be inserted into the light tube 2. The inserted first straight torsion arm 74 and second straight torsion arm 76 are adjusted, so that the connection portion between the first straight torsion arm 74 and the first fixing hook portion 75 and the connection portion between the second straight torsion arm 76 and the second fixing hook portion 77 are fitted in a support 4 of the light tube 2.

Finally, the embedded LED lamp is pushed into the light tube 2, so that the embedded LED lamp is fully installed in light tube 2.

An embedded LED lamp can be conveniently connected with different types of light tubes 2, due to, for example, the presence of the push-in terminal 13, the spring securing element 60, and the metal torsion spring 70, 2.

In the preceding specification, various preferred embodiments have been described with reference to the accompanying drawings. It will, however, be evident that various other modifications and changes may be made thereto, and additional embodiments may also be implemented, without departing from the broader scope of the invention as set forth in the claims that follow.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

I claim:

1. An embedded LED lamp, comprising:
a power supply device;
a lampshade;
an LED light module;
a reflector; and
a lens,
wherein:
the power supply device comprises a cup-shaped housing and a power supply unit provided within the housing;
an opening end of the housing is detachably connected to an outer side of a bottom surface of the lampshade;
the reflector is positioned within the lampshade;
the reflector is detachably connected to an inner side of the bottom surface of the lampshade;
a large opening at a front end of the reflector is detachably connected to the lens; and
the LED light module is attached at the inner side of the bottom of the lampshade and in an area surrounded by an opening at a rear end of the reflector.

2. The embedded LED lamp of claim 1, further comprising a lamp ring, wherein:
the lamp ring is matched and assembled with an opening of the lampshade.

3. The embedded LED lamp of claim 1, further comprising:
a spring securing element and a metal torsion spring, wherein:
the spring securing element has a fixing portion, a connecting portion, and a snap-fit portion;
the fixing portion, the connecting portion, and the snap-fit portion are integrally formed;
the fixing portion is detachably connected to the outer side of the bottom surface of the lampshade;
the connection portion extends from the fixing portion and is connected to or fitted with a side wall of the lampshade;
the snap-fit portion extends from the connection portion and includes a snap-fit collar; and
the metal torsion spring is provided in the snap-fit collar.

4. The embedded LED lamp of claim 3, wherein:
the fixing portion is provided with a hook portion;
a curvature of the connecting portion is substantially the same as that of an outer side of the side wall the lampshade;
the snap-fit portion comprises a first snap-fit portion and a second snap-fit portion extending from the first snap-fit portion;
a cross-section of the snap-fit portion is S-shaped; and
a cross-sectional radius of the first snap-fit portion is not equal to that of the second snap-fit portion.

5. The embedded LED lamp of claim 3, wherein:
the metal torsion spring is formed by two small coils and a large coil;
each of the two small coils and the large coil are coiled separately;
the large coil is located between the two small coils; and
a first torsion arm and a second straight torsion arm extend from the two small coils, respectively, toward a same side.

6. The embedded LED lamp of claim 1, wherein:
the lampshade is made of a conductive material and
the side wall of the lampshade is threaded.

7. The embedded LED lamp of claim 2, wherein:
the lampshade is made of a conductive material and
the side wall of the lampshade is threaded.

8. The embedded LED lamp of claim 3, wherein:
the lampshade is made of a conductive material and
the side wall of the lampshade is threaded.

9. The embedded LED lamp of claim 1, wherein:
the outer side of the bottom surface of the lampshade is provided with a positioning groove and
the housing is respectively engaged with the positioning groove.

10. The embedded LED lamp of claim 2, wherein:

the outer side of the bottom surface of the lampshade is provided with a positioning groove and the housing is engaged with the positioning groove.

11. The embedded LED lamp of claim 3, wherein:

the outer side of the bottom surface of the lampshade is provided with a positioning groove and the housing and the spring securing element are respectively engaged with opposite sides of the positioning groove.

12. The embedded LED lamp of claim 1, wherein:

an outer side of the side wall of the reflector is provided with a plurality of evenly spaced cylinders;

a plurality of projections are provided on bottom surface of the lampshade at positions that correspond to those of the cylinders; and the cylinders and projections have threaded holes and are configured to be respectively attached with screws.

13. The embedded LED lamp of claim 1, wherein:

the power supply device further comprises a push-in terminal and the push-in terminal is connected to the power supply unit.

14. The embedded LED lamp of claim 2, wherein a cross-section of lamp ring is arc-shaped.

* * * * *